United States Patent [19]

Dittrich

[11] Patent Number: 4,465,277

[45] Date of Patent: Aug. 14, 1984

[54] BASKETBALL GOAL STRUCTURE

[75] Inventor: William A. Dittrich, Seattle, Wash.

[73] Assignee: Dunk King Inc., Seattle, Wash.

[21] Appl. No.: 33,852

[22] Filed: Apr. 27, 1979

Related U.S. Application Data

[63] Continuation-in-part of Ser. No. 832,661, Sep. 12, 1977, Pat. No. 4,151,989, which is a continuation-in-part of Ser. No. 707,325, Jul. 21, 1976, abandoned.

[51] Int. Cl.[3] ..... A63B 63/08

[52] U.S. Cl. ..... 273/1.5 A; 273/1.5 R

[58] Field of Search ..... 273/1.5 R, 1.5 A; 172/72, 264–266, 484; 248/475 B

[56] References Cited

U.S. PATENT DOCUMENTS

| | | | |
|---|---|---|---|
| 418,503 | 12/1889 | Crane | 172/266 |
| 1,194,006 | 8/1916 | Fry | 172/265 |
| 2,049,593 | 8/1936 | Schabinger | 273/1.5 R |
| 2,230,813 | 2/1941 | Pressman | 273/1.5 R |
| 2,742,843 | 4/1956 | Redetzke | 172/264 X |
| 2,786,678 | 3/1957 | Fink | 273/1.5 R |
| 2,889,149 | 6/1959 | Williams . | |
| 2,932,511 | 4/1960 | Bemis . | |
| 2,939,705 | 6/1960 | McCall, Jr. . | |
| 2,986,395 | 5/1961 | Sheftel . | |
| 2,997,117 | 8/1961 | Paige | 172/484 |
| 3,012,781 | 12/1961 | Nelson . | |
| 3,017,183 | 1/1962 | Chalcroft . | |
| 3,018,102 | 1/1962 | Murphy . | |
| 3,025,058 | 3/1962 | Brumfield . | |
| 3,137,502 | 6/1964 | Duganich . | |
| 3,181,849 | 5/1965 | Mitchell . | |
| 3,194,555 | 7/1965 | Humphrey | 273/1.5 R |
| 3,258,266 | 6/1966 | Kamish . | |
| 3,341,197 | 9/1967 | Bottorff . | |
| 3,365,196 | 1/1968 | Miller | 273/1.5 A |
| 3,427,025 | 2/1969 | Procter . | |
| 3,462,143 | 8/1969 | Bidelman et al. . | |
| 3,534,956 | 10/1970 | Myers | 273/1.5 A |
| 3,586,324 | 6/1971 | Bearson . | |
| 3,598,406 | 8/1971 | Robinson . | |
| 3,650,530 | 3/1972 | Gantz . | |
| 3,669,450 | 6/1972 | Mason . | |
| 3,722,886 | 3/1973 | Sinner . | |
| 3,765,676 | 10/1973 | Bearson et al. | 273/1.5 R |
| 3,795,396 | 3/1974 | Kropelnitski . | |
| 3,802,702 | 4/1974 | Pulley | 273/1.5 R |
| 3,881,724 | 5/1975 | Beveridge . | |
| 4,111,420 | 9/1978 | Tyner | 273/1.5 R |

FOREIGN PATENT DOCUMENTS

| | | | |
|---|---|---|---|
| 2515767 | 10/1975 | Fed. Rep. of Germany | 172/72 |
| 1479428 | 3/1967 | France | 248/475 B |
| 286216 | 2/1965 | Netherlands | 273/1.5 R |
| 908055 | 10/1962 | United Kingdom | 273/1.5 R |

OTHER PUBLICATIONS

Slam Dunk Rim, Inc., Sales Literature, 4–1978.

*Primary Examiner*—Paul E. Shapiro

*Attorney, Agent, or Firm*—Ward Brown; Robert W. Beach

[57] ABSTRACT

A cantilever boom supports a padded basketball hoop above a specified area of a playing surface in a normal horizontal position. The arm can swing universally to permit substantial vertical and/or sideways deflection of the hoop by the application of corresponding forces thereto, such as during the practice of dunk shots. Resilient members bias the hoop to its normal position.

6 Claims, 8 Drawing Figures

BASKETBALL GOAL STRUCTURE

CROSS-REFERENCE

This application is a continuation-in-part of U.S. application Ser. No. 832,661, now U.S. Pat. No. 4,151,989 filed Sept. 12, 1977, for Basketball Practice Device, which is a continuation-in-part of U.S. application Ser. No. 707,325, filed July 21, 1976, for Basketball Dunking Device, now abandoned.

BACKGROUND OF THE INVENTION

1. Field of the Invention

The present invention relates to a basketball goal structure including a hoop displaceable from a normal horizontal position by the application of force to the hoop.

2. Prior Art

Various types of prior basketball hoop-supporting structures permit vertical adjustment of the height of a basketball hoop above a playing surface. For example, Bearson U.S. Pat. No. 3,586,324 and Bearson et al. U.S. Pat. No. 3,765,676 each disclose a basketball hoop support using parallel arms in which a hoop is held substantially stationary in horizontal position at any one of several different elevations above a playing surface. Other prior hoop-supporting structures are foldable and/or retractable to a compact condition for storage. Still other prior hoop-supporting structures are portable. Several prior known structures have a combination of these features. However, each of the prior known devices is designed to support a basketball hoop substantially stationarily in a predetermined established position. Consequently, in practicing the dunk shot with any of the above devices, there is a high risk of injury to a player or to the hoop-supporting structure from the player striking or hanging onto the fixedly positioned hoop.

Devices for measuring or increasing jumping ability are disclosed in the following United States patents:

McCall, Jr., U.S. Pat. No. 2,939,705
Nelson, U.S. Pat. No. 3,012,781
Kamish, U.S. Pat. No. 3,258,266
Kropelnitski, U.S. Pat. No. 3,795,396

Measurement or development of jumping ability by the device of any of these patents requires tedious and repetitive jumping. Further, none of these devices uses a basketball hoop.

No prior basketball hoop-supporting structure is known which is designed to permit downward and/or sideways deflection of a hoop by application of force to the hoop such as the force which may be applied during execution of a dunk shot.

SUMMARY OF THE INVENTION

It is an object of the present invention to provide a basketball goal structure usable to develop various basketball skills including jumping ability, timing and coordination.

It is also an object to provide such a structure, the use of which will not be tedious to a practicing basketball player.

In accordance with the above objects, it is an object to provide a device for practicing the dunk shot safely.

The foregoing objects can be accomplished by providing a basketball hoop supported by structure permitting substantial vertical and/or sideways deflection of the hoop. In the preferred embodiment of the invention, the hoop is padded and is mounted on the end of a cantilever boom for vertical swinging about a generally horizontal pivot, and for sideways swinging about an upright pivot, both of such pivots being offset from the hoop. Resilient members bias the hoop to a normally horizontal position and at least one of such resilient members is adjustable to alter the degree of its biasing force. A shock absorber damps swinging of the hoop.

DETAILED DESCRIPTION

Figures 1, 2, 3, 4:
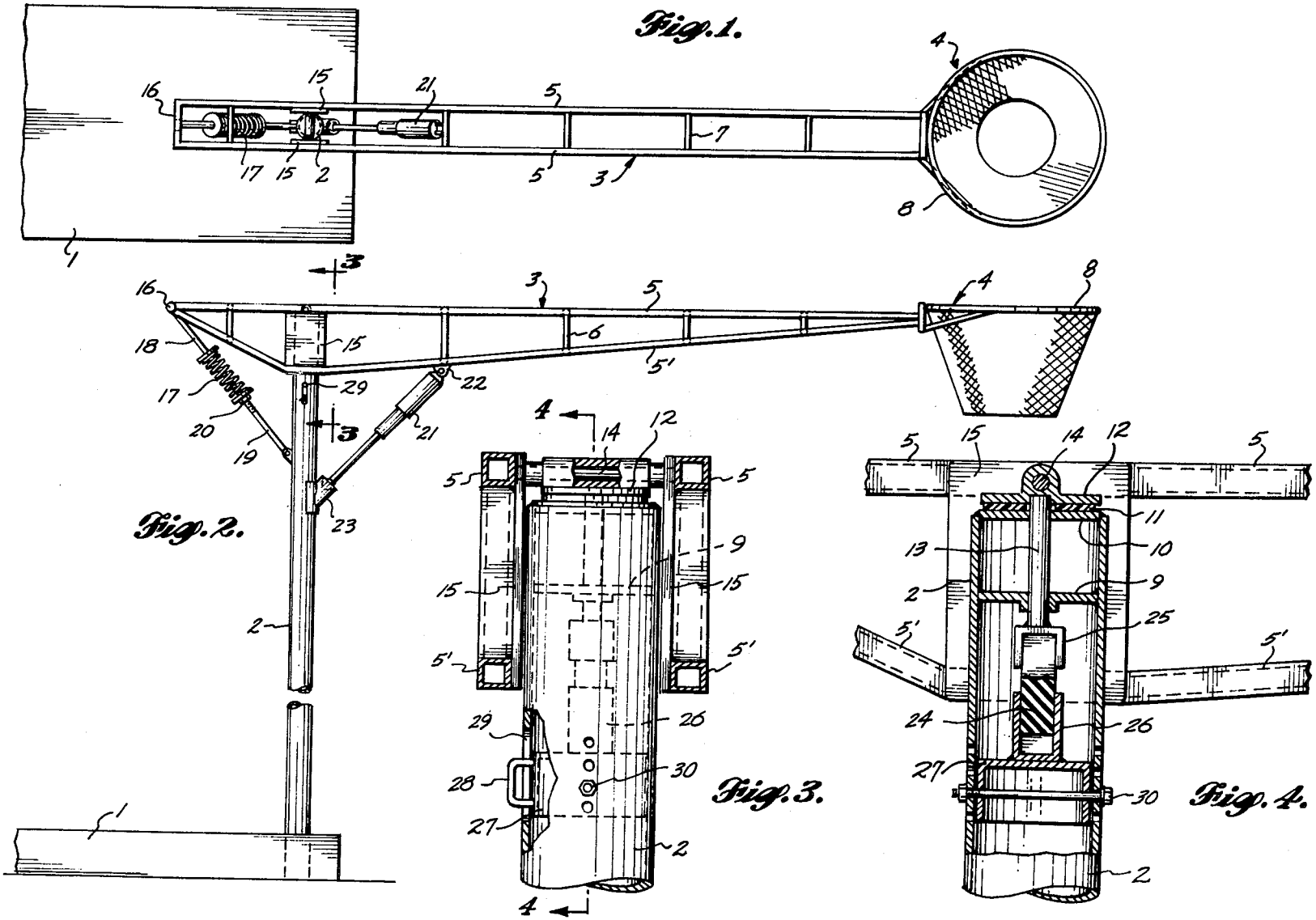
FIG. 1 is a top plan of a basketball goal structure in accordance with the present invention with parts broken away.
FIG. 2 is a side elevation of the goal structure of FIG. 1 with parts broken away.
FIG. 3 is an enlarged fragmentary section taken on line 3—3 of FIG. 2.
FIG. 4 is an enlarged fragmentary section taken on line 4—4 of FIG. 3.

As used herein, the term "dunk shot" means a basketball shot in which a basketball is forced directly through a hoop by a downward thrust motion of a player's hand on the basketball.

There has been increased interest by basketball spectators in the execution of the dunk shot. Naturally, as so-called dunk shot artists receive more recognition by spectators, basketball players become motivated to increase their dunk shot skills. Such motivation is beneficial because the particular skills necessary for graceful execution of the dunk shot, such as jumping ability, timing and coordination, are needed for other facets of the game. However, dunk shot practice with conventional stationary hoops is dangerous both to players and to the hoop-supporting structure because a practicing player often strikes or grabs the hoop. In accordance with the present invention, the risk of injury to the supporting structure and the player is reduced by padding the hoop and by including in the supporting structure mechanism allowing substantial downward and/or sideways deflection of the hoop.

In the embodiment of the invention shown in FIGS. 1 through 4, a base 1 supports an upright standard 2. In order that the goal structure may be used by players of varying jumping abilities, it is preferred that the standard be of adjustable height. The free end of a normally horizontal cantilever boom 3 carries a regulation, substantially rigid, metal basketball hoop 4. Such boom is mounted on the standard by a universal joint system permitting deflection of the hoop by swinging of the boom. To conserve weight, the boom is formed of tubular upper and lower longitudinal members 5 and 5', respectively, connected by tubular vertical and horizontal cross members 6 and 7, respectively. For safety, elastomer padding 8, such as vinyl or polyurethane foam or sponge rubber, covers the hoop.

As best seen in FIG. 4, at least the upper end portion of standard 2 is hollow. A stationary horizontal guide plate 9 is secured inside the upper end portion of the standard below a disc 10 capping the standard upper end. An antifriction member, such as a Teflon pad 11 or a thrust bearing, is interposed between the upper side of the disc cap and the underside of a turntable 12 having an upright pivot shaft 13 journaled in aligned apertures in the disc cap and guide plate. The shaft is coaxial with the upper end portion of the standard. The central portion of a horizontal pivot shaft 14 is journaled in a bearing carried by the turntable and has its opposite ends secured, respectively, to upright parallel plates 15 which connect the upper and lower longitudinal support members 5 and 5' at opposite sides of the standard. As shown in FIG. 3, plates 15 are located close alongside opposite sides of the standard upper portion so that slight swivelling of the boom will engage a plate with the standard to prevent excessive stress from being transmitted to the upright pivot shaft by forces tending to tilt the turntable. However, the plates are spaced apart slightly farther than the width of the standard so as not to hinder vertical swinging of hoop 4 about the axis of horizontal shaft 14, or sideways swinging of the hoop about the axis of upright shaft 13.

As best seen in FIG. 2, the supported end of the hoop-supporting boom 3 extends past the axis of horizontal shaft 14 oppositely from hoop 4. A resilient member is connected between the standard and the overhanging end 16 of such oppositely extending boom portion for biasing the hoop to a normal horizontal position. In the embodiment shown in FIGS. 1 through 4, such resilient member is a tension spring 17 connected between normally aligned upper and lower rods 18 and 19 secured to boom end 16 and standard 2, respectively. Upper rod 18 is fixed relative to the hoop-supporting boom and lower rod 19 is fixed relative to the standard, so that sidewise swinging of the boom moves such rods out of alignment to bend and stretch spring 17. Consequently, such tension spring resists sideways swinging of the hoop as well as vertical swinging of the hoop. The tension of the spring is adjustable by an adjusting nut 20 threaded on the lower rod.

Vertical swinging of the hoop can be damped by a shock absorber 21 having an upper end pivotally secured to the hoop-supporting boom by a lug 22 and a lower end universally secured to the standard by a ball and socket joint 23.

Auxiliary adjustable resilient mechanism for resisting sideways deflection of the hoop and for returning the boom 3 to a normal centered position may be connected to the central joint system as shown in FIGS. 3 and 4. A torsion rod 24, such as a length of rubber of square cross section, is secured to the lower end of upright pivot shaft 13 by a socket 25 receiving the upper end of such rod. The lower end portion of the torsion rod is slidably received in a lower socket 26 carried by an adjustment member 27 slidable inside the standard. The adjustment member has a handle 28 projecting through a vertical slot 29 in the standard so that the position of the adjustment member and its socket relative to the standard and the torsion rod can be varied.

The adjustment member can be secured in any of several positions by a pin 30 extending through aligned apertures in the standard and the adjustment member. Sliding of member 27 upward relative to the standard and the torsion rod decreases the effective length of the torsion rod, that is the length between sockets 25 and 26, increasing the restoring biasing force exerted by the torsion rod upon sidewise deflection of the boom 3. Conversely, sliding of member 27 downward increases the effective length of the torsion rod making it easier to swing hoop 4 about the axis of upright pivot shaft 13. Consequently, the sideways biasing force on the hoop support structure can be adjusted independently of the vertical biasing force. Each of such forces can be adjusted according to the experience and strength of a player.

In the preferred embodiment of the present invention shown in FIGS. 5 through 8, a base 1' supports a generally upright standard 2' having substantially vertical lower and upper standard portions 31 and 32, respectively, joined in offset relationship by an inclined central portion 33. Boom structure 3' including lower and upper substantially parallel arms or boom members 34 and 35, respectively, are cantilevered from the upper end of upper standard portion 32 and extend over and beyond the inclined standard portion 33. The outer ends of such boom members are pivotally connected to a backboard 36 carrying a hoop 4.

Figure 7:
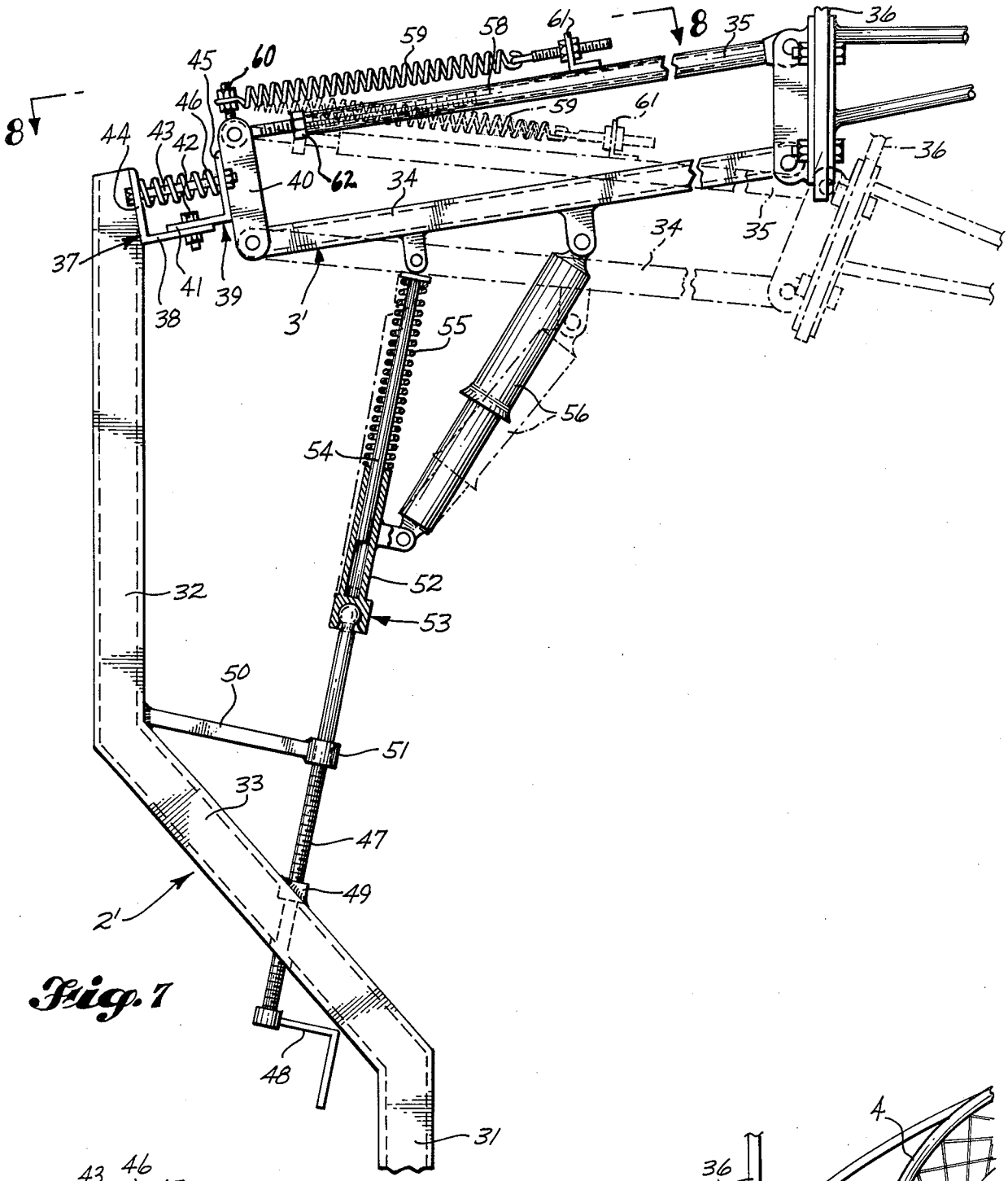
FIG. 7 is a somewhat diagrammatic enlarged fragmentary side elevation of the basketball goal structure of FIG. 5 with parts shown in section.
Figure 8:
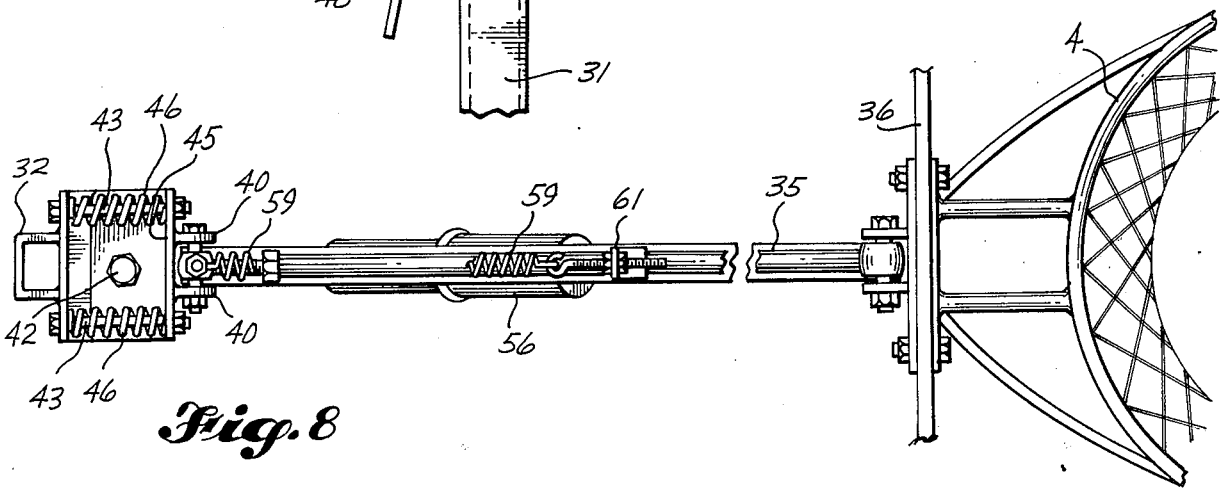
FIG. 8 is a fragmentary top plan taken along line 8—8 of FIG. 7.

As best seen in FIG. 7, the mechanism connecting the boom structure 3' to the standard 2' includes an angle bracket 37 rigidly connected to the upper end of upper standard portion 32 and having a flange 38 projecting outward toward the boom structure. Another angle bracket 39 is rigidly connected to side plates 40 pivotally carrying the inner ends of boom members 34 and 35 and includes a flange 41 projecting inward toward the standard and resting on flange 38 of bracket 37. Such bracket flanges are pivotally connected by an upright pivot bolt 42 such that the boom structure can swing from side to side relative to the standard about the axis of the pivot bolt. Parallel side-by-side pins 43, slidably received in aligned apertures in the upright flanges 44 and 45 of brackets 37 and 39, respectively, extend axially through helical compression springs 46 between such upright flanges on opposite sides of pivot bolt 42 for returning the boom structure to a normal centered position when it is deflected sidewise to either side of such centered position. Another type of resilient member, such as a thick rubber pad, could be substituted for the compression springs 46.

The connections of the inner ends of the parallel boom members 34 and 35 to standard 2' and the outer ends of such boom members to the backboard 36 by horizontal pivots guide the backboard and the hoop for elevational displacement with the backboard remaining substantially vertical and the hoop remaining substantially horizontal. Boom members 34 and 35 serve as parallel, generally horizontal links.

Figure 5:
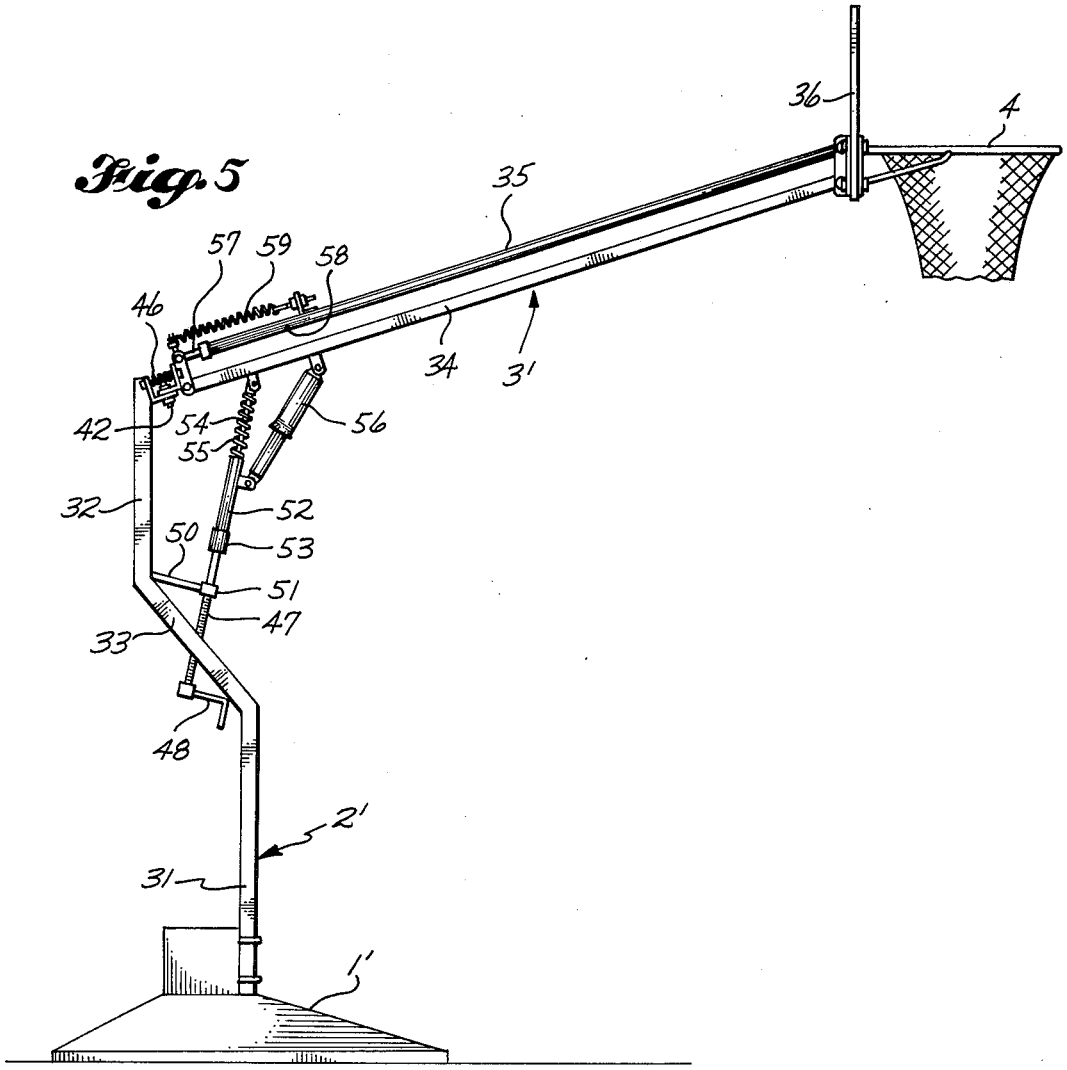
FIG. 5 is a side elevation of an alternative form of basketball goal structure in accordance with the present invention.
Figure 6:
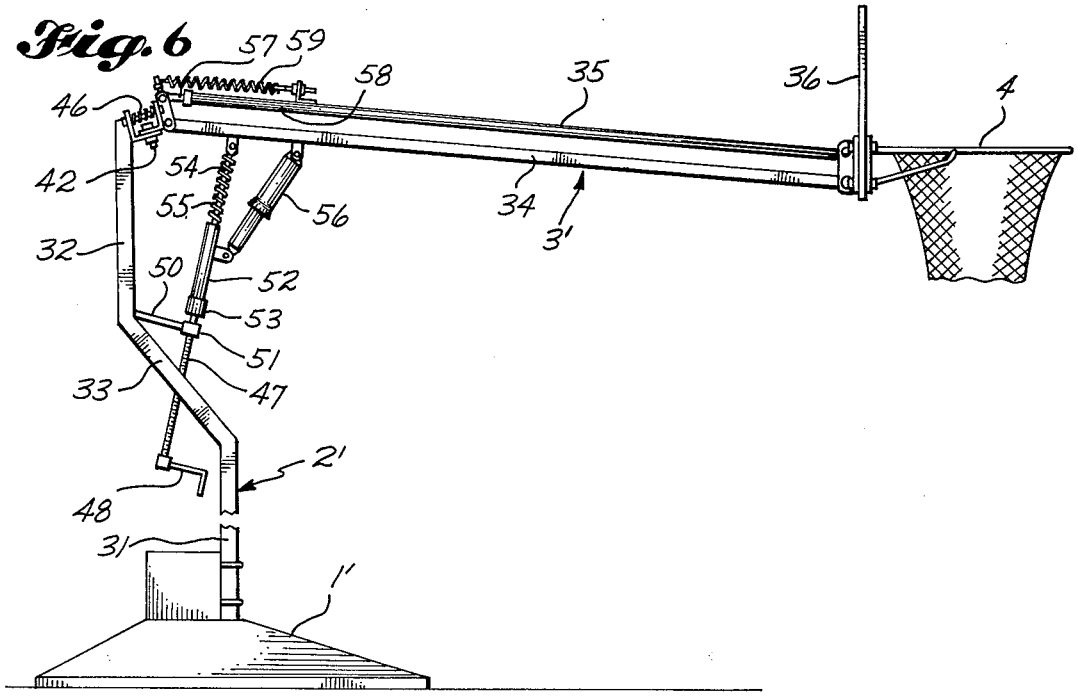
FIG. 6 is a corresponding side elevation with parts in different positions.

For adjusting the elevation of the normal position of the backboard and hoop above a playing surface, a threaded rod 47 having a crank handle 48 extends through a nut 49 carried by the inclined standard portion 33. Such rod is supported upright by a support arm 50 projecting from standard portion 32 and having a guide collar 51 receiving rod 47. The upper end of rod 47 is connected to an upright sleeve 52 by a ball and socket joint 53. Another upright rod 54 has its lower end portion slidably received in sleeve 52 and its upper end pivotally connected to the lower boom member 34 of boom structure 3'. A helical compression spring 55 encircles the portion of rod 54 projecting upward from sleeve 52 and normally maintains the length of such projecting rod portion constant. Consequently, as shown in FIGS. 5 and 6, the elevation of the backboard and hoop above a playing surface is adjustable through a wide range by turning crank 48 to swing the boom structure 3'. In all elevationally adjusted positions the attitude of the hoop is substantially unchanged, that is, the hoop remains substantially horizontal.

A substantial downward force applied to the hoop, such as the force which may be exerted on the hoop during execution of a dunk shot, moves the hoop downward and displaces the rod 54 downward, compressing spring 55 and decreasing the length of the portion of rod 54 projecting upward from sleeve 52. This type of elevational displacement of the hoop is damped by a shock absorber 56 connected between sleeve 52 and the lower boom member 34.

Preferably, the strength of spring 55 is sufficient to permit downward swinging of the boom structure and downward displacement of the backboard and hoop only if the downward force applied to the hoop is so strong as to risk damage to the hoop-supporting structure, such as by bending the hoop or the boom members. However, particularly for small or weak players, there is a substantial chance that injury to a player could occur by the player striking the hoop with insufficient force to compress spring 55. Consequently, in the preferred embodiment of the invention another resilient member, adjustable in accordance with the strength, size or experience of players using the basketball practice device, permits downward tilting of the hoop.

As best seen in FIG. 7, while the lower boom member 34 is rigid and of constant length, the upper boom member includes a threaded rod 57 pivotally connected to sideplates 40 and having an outer end portion slidably received in a sleeve 58 pivotally connected to the hoop-supporting backboard. A tension spring 59 has its inner end rigidly connected to the inner end of rod 57 by a bolt 60 and its outer end adjustably connected to sleeve 58 by a mounting bracket 61. Such tension spring normally holds the inner end of sleeve 58 against a stop nut 62 carried by rod 57. In this position, the backboard is substantially vertical. However, application of a downward force to the hoop sufficient to overcome the biasing force of spring 59 stretches the spring, increasing the effective length of the upper boom member 35, which results in tilting of the backboard and the hoop about the axis of the pivotal connection of the outer end of lower boom member 34 to the backboard.

For small, weak or inexperienced players, the biasing force of spring 59 is adjusted to be substantially less than the biasing force of spring 55. Consequently, when an excessive downward force is applied to the hoop, the hoop will tilt downward without being elevationally displaced by swinging of the boom structure. For strong players, the biasing force of spring 59 can be adjusted to be substantially as great as the biasing force of spring 55 so that, as shown in broken lines in FIG. 7, an excessive downward force applied to the hoop will effect both tilting of the hoop and downward displacement of the hoop, or the biasing force of spring 59 can be adjusted to much greater than the force of spring 55 so that an excessive downward force applied to the hoop will displace it elevationally without tilting it. In any of these instances, as in the device of FIGS. 1 through 4, the biasing forces hold the hoop substantially stationary until a force in excess of a predetermined force is applied to the hoop. The value of the predetermined force should be sufficient that the hoop remains substantially stationary during normal execution of dunk shots and is deflected only if a force sufficiently excessive as to cause damage to the hoop-supporting structure or injury to the player is applied to the hoop.

By combining a basketball practice device in accordance with the present invention with mechanism allowing adjustment of the vertical height of a hoop above a playing surface, a practice device for developing basketball skills is provided for all players regardless of height or ability. Because of the great interest in the dunk shot, use of the practice device is enjoyable and, consequently, players need little encouragement to use the device.

I claim:

1. In a basketball goal structure including a basketball hoop and means for normally supporting the hoop substantially stationary in a predetermined position, the improvement comprising the supporting means including deflection means separate from the hoop and mounting the hoop for substantial movement from the predetermined position by application of force to the hoop such as the force which may be applied to the hoop during execution of a dunk shot for preventing the goal structure from being damaged by force exerted on the hoop during execution of such shot and resilient means separate from the hoop for biasing the hoop to the predetermined position, said deflection means including pivot means mounting the hoop for tilting bodily downward about a generally horizontal axis.

2. In the basketball goal structure defined in claim 1, the pivot means mounting the hoop for tilting bodily downward about a generally horizontal axis located generally behind the hoop.

3. In the basketball goal structure defined in claim 1, the deflection means mounting the hoop for movement from the predetermined position in response to a force in excess of a predetermined force being applied to the hoop.

4. In a basketball goal structure including a basketball hoop and means for supporting the hoop in a normal horizontal position, the improvement comprising the supporting means including pivot means mounting the hoop for tilting bodily downward from such horizontal position about a generally horizontal axis located generally behind the hoop by the application of a downward force to the hoop such as the force which may be exerted on the hoop by a player during the execution of a dunk shot for protecting the goal structure from being damaged by force exerted on the hoop during execution of such shot.

5. In the basketball goal structure defined in claim 2 or 4, the basketball hoop forming a closed ring and the generally horizontal axis being offset a substantial distance from the ring of the hoop.

6. In a basketball goal structure including a basketball hoop and means for normally supporting the hoop substantially stationary in a predetermined position, the improvement comprising the supporting means including deflection means separate from the hoop and mounting the hoop for substantial movement from the predetermined position by application of force to the hoop such as the force which may be applied to the hoop during execution of a dunk shot for preventing the goal structure from being damaged by force exerted on the hoop during execution of such shot and resilient means separate from the hoop for biasing the hoop to the predetermined position, and the improvement further comprising means for adjusting the force applied by said resilient means.

* * * * *